United States Patent [19]

Weavers

[11] 4,153,178

[45] May 8, 1979

[54] DOUBLE-ACTING LATCH FOR HINGED PLASTIC BOX

[75] Inventor: Mark W. Weavers, Little Canada, Minn.

[73] Assignee: Minnesota Mining and Manufacturing Company, St. Paul, Minn.

[21] Appl. No.: 896,603

[22] Filed: Apr. 14, 1978

[51] Int. Cl.[2] ..... B65D 41/16

[52] U.S. Cl. ..... 220/306; 220/315; 206/387; 150/0.5; 292/DIG. 48

[58] Field of Search ..... 220/306, 416, 315; 206/387; 292/32, 57, DIG. 42, DIG. 48; 150/0.5

[56] References Cited

U.S. PATENT DOCUMENTS

| | | | |
|---|---|---|---|
| 3,536,435 | 10/1970 | Schurman et al. | 150/0.5 |
| 3,902,628 | 9/1975 | Schurman | 220/306 |
| 3,933,381 | 1/1976 | Schurman | 292/57 |
| 4,078,657 | 3/1978 | Schurman | 206/387 |

*Primary Examiner*—George T. Hall

*Attorney, Agent, or Firm*—Cruzan Alexander; Donald M. Sell; Robert E. Granrud

[57] ABSTRACT

Latch for a hinged plastic box wherein a flexible plastic slide fits around the shoulders of a T-shaped rail projecting from the cover part of the box. A tab projecting from the container part of the box fits into a notch in the rail, after which the slide is moved along the rail to latch the cover part to the container part. A detent on the slide then is snapped into place against the rail to provide second latching action.

9 Claims, 3 Drawing Figures

DOUBLE-ACTING LATCH FOR HINGED PLASTIC BOX

FIELD OF THE INVENTION

This invention concerns a novel latch for blow-molded plastic storage and shipping boxes of double-wall construction.

BACKGROUND OF THE INVENTION

Blow-molded plastic boxes of double-wall construction are widely used where economy, durability and light weight are desired. The light weight reduces shipping costs, and the double-wall construction provides cushioning against shocks. Such boxes may have molded integral snap-type latches as in U.S. Pat. No. 3,536,435 (Schurman et al.) and U.S. Pat No. 3,659,999 (Schurman). As noted in U.S. Pat. No. 3,933,381 (Schurman), such latches have been deficient in strength and durability and are particularly vulnerable to opening under accidental jarring impact.

The latter patent deals with this problem by employing a sliding metal bolt which is formed from a wire. A loop in the wire acts as handle and as a detent means, snapping into locked position behind a protuberance 42 as seen in FIG. 4. While this bolt-type latch provides much more secure latching, it involves the extra cost of drilling out the ends of the groove which carries the bolt. In actual use, the loop has sometimes been accidentally knocked out of its detented position, and further jarring has allowed the bolt to move to the open position, thus spilling the contents of the box.

OTHER PRIOR ART

The latch of the present invention is similar to latching mechanisms such as was employed in the plastic "Bullet" camera which was popular in the 1930s. The "Bullet" latch employed a metal slide and did not provide the sort of assured locking that is needed for shipment in the mails.

THE PRESENT INVENTION

The present invention provides a double-acting latch for a hinged plastic box which is believed to be of more economical construction than the bolt-type latch of U.S. Pat. No. 3,933,381 while being virtually immune from accidental opening. The novel latch inherently presents a clean, uncluttered appearance and is readily engineered at low cost to have a useful life equal to that of the box. Laboratory tests of a blow-molded plastic box of double-wall construction equipped with the novel latch indicate that the latch should be able to withstand rough treatment such as that sometimes encountered in the mails while remaining virtually immune to accidental opening. The novel latch should also have a long useful life while affording economy of construction in other types of plastic boxes which have hinged container and cover parts.

In the latch of the present invention, a flexible slide fits around the shoulders of a T-shaped rail which is integral with a sidewall of one of the hinged parts. The slide is movable along the rail between open and locked positions. One shoulder of the rail and one flange of the slide are formed with notches which are aligned when the slide is at the open position. A tab integral with the other of said parts fits into the notch in the rail when the box is closed while the slide is at the open position. The tab is retained by said one flange upon movement of the slide toward the closed position to latch the two box parts together. A detent integral with the slide is adapted for snap-fitting engagement with the rail when the slide is at its locked position to provide a second latching action.

THE DRAWING

A blow-molded, double-wall plastic box having a double-acting latch of the invention is schematically illustrated in the drawing wherein.

Figure 1:
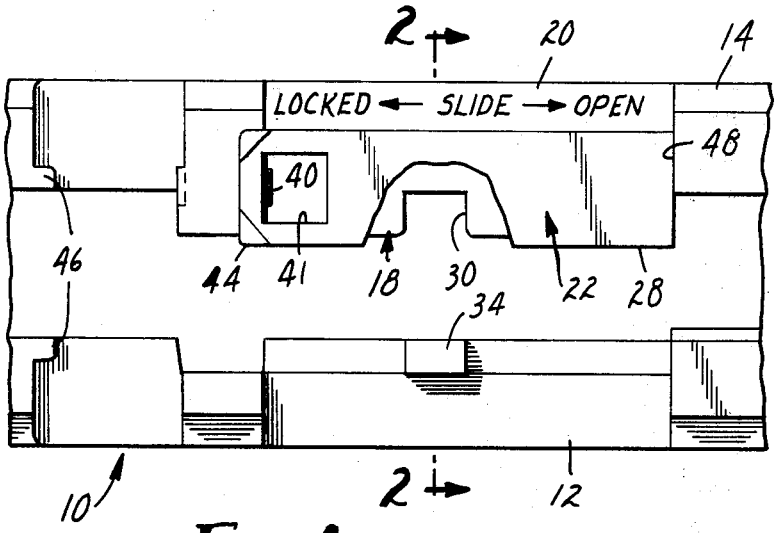
FIG. 1 is a front elevation with the box partly opened.

The box 10 shown in the drawing comprises a container part 12 and a cover part 14 of blow-molded double-wall construction which are hinged together at 16. Its latching mechanism includes a rail 18 of T-shaped cross-section integrally molded with the cover part 14 and extending along its sidewall 20. A flexible plastic slide 22 fits around shoulders 24 and 26 of the rail 18. The trunk 27 and one shoulder 26 of the rail have a notch 30 which is aligned with a notch 32 in the adjacent flange 28 of the slide 22 when it is in the open position shown in FIG. 1. A tab 34, having a shoulder 36 and trunk 37 of the same contour as the shoulder 26 and trunk 27 of the rail 18, projects from the container part 12 and fits into the notch 30 of the rail 18 upon closing the box with the slide in the open position. Movement of the slide traps the tab behind the flange 28, thus latching the box.

Figure 3:
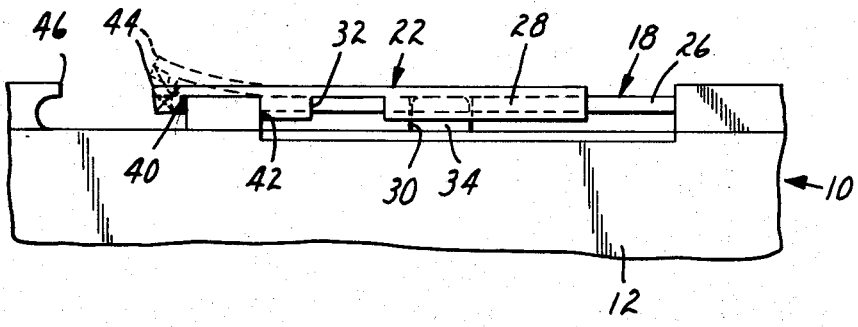
FIG. 3 is a bottom view, partly broken away, with the box closed and the slide of the latch in the locked position.

A detent 40 projecting from the slide 22 rests on the rail 18 as the slide is moved from the open position. Both the flange 28 and the other flange of the slide are cut away in the vicinity of the detent 40, and there is an opening 41 in the central portion of the slide to enhance the flexibility of that portion of the slide. The slide can be moved away from the open position until the leading edge of the flange 28 is stopped by an abutment 42 at the side of the rail 18. In this position as shown in FIG. 3, the detent 40 rests on the very end of the rail (as indicated in dotted lines). When pressed down, the detent 40 snaps over the end of the rail and into an undercut (as indicated in solid lines in FIG. 3) to provide a second latching action.

The top surface of the slide 22 at the corners 44 adjacent its detent 40 is beveled to divert accidental blows that might otherwise dislodge the detent from its latched position. Also helping to protect the slide from accidental blows is a hook 46 which is formed in both the container and cover parts. The primary function of the hook 46 is to permit a plurality of boxes to be hung side-by-side from a horizontal ledge. The slide 22 extends a small distance beyond the detent 40 to facilitate removal of the detent 40 from the rail undercut, there being adequate clearance to permit this to be done with one's finger. Upon moving the slide 22 back to the open position, it strikes a protrusion 48 on the cover part 14, at which point the notches 30 and 32 are again aligned to release or receive the tab 34. Words and arrows imprinted in the sidewall 20 of the cover part as shown in FIG. 1 alert the user to this sliding, locking action.

Figure 2:
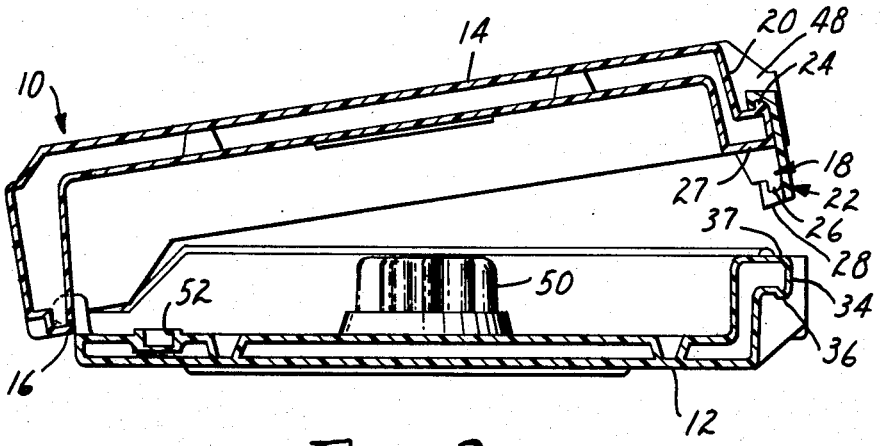
FIG. 2 is a section along line 2—2 of FIG. 1.

The box illustrated in the drawing is intended for storage and shipment of a videocassette and accordingly has a pair of hubs, one of which 50 is seen in FIG. 2, for holding the reels of the videocassette. Each hub 50 is fluted, and the blow-molding inherently produces relatively thin walls at the tips of the flutes. By employing a plastic such as high-density polyethylene which is tough and resilient in thin sections, the flutes of the hub are somewhat resilient. By making the diameter of the resilient flutes of the hub 50 slightly greater than the inside diameter of the reels of videocassettes, the flutes frictionally restrain the reels against rotational movement.

The slide 22 should be molded of a plastic material which can be flexed repeatedly without injury such as polyethylene or polypropylene. Broad portions of its outer surfaces are corrugated to facilitate sliding it back and forth along the rail. The outer edges of the shoulders 24 and 26 of the rail 18 are rounded as shown in FIG. 2 to permit the slide 22 to be assembled simply by snapping it into place. The inner edges of the shoulders 24 and 26 are sharp to guard against accidental disassembly of the slide.

As shown in FIG. 2, the container part 12 of the box has an opening 52 for temporary storage of a record-enable button (not shown ) for a videocassette.

I claim:

1. In a plastic box comprising hinged container and cover parts, an improved double-acting latch comprising:

a rail of T-shaped cross-section extending along and integral with a sidewall of one of said parts, a flexible plastic slide having flanges fitting around the shoulders of the T-shaped rail and being slidable along the rail between open and locked positions, one shoulder of the rail and one flange of the slide being formed with notches which are aligned when the slide is at the open position, a tab integral with the other of said parts and adapted to fit into the notch in the rail when the box is closed while the slide is at the open position and to be retained by the notched flange upon movement of the slide toward the locked position to latch the two box parts together, and a detent integral with the slide adapted for snap-fitting engagement and disengagement with the rail when the slide is at its locked position to provide a second latching action.

2. In a plastic box as defined in claim 1 and of blow-molded double-wall construction, a latch wherein the notch in the rail extends into its trunk and the tab has a trunk and shoulder which continue the contour of the rail across its notch when the box is closed.

3. In a plastic box as defined in claim 2, a latch wherein said detent is at one end of the slide, the leading edge of one of said flanges terminates short of said end, the rail is formed with an abutment which is contacted by said leading edge when the slide is at its locked position, and detent is adapted to resiliently snap over the end of the rail when the slide is at its locked position.

4. In a plastic box as defined in claim 3, a latch wherein the end of the rail is undercut to receive the detent.

5. In a plastic box as defined in claim 4, a latch wherein the corners of the slide adjacent the detent are beveled to ward off accidental blows which might otherwise dislodge the detent from the undercut in the end of the rail.

6. In a plastic box as defined in claim 1, a latch wherein the outer edges of the shoulders of the rail are rounded to permit the slide to be snapped onto the rail during assembly of the latch.

7. In a plastic box as defined in claim 3, a latch wherein both flanges of the slide terminate short of said one end of the slide and there is an opening in the central portion of the slide adjacent its detent to enhance the flexibility of that portion of the slide.

8. In a plastic box as defined in claim 7, a latch wherein the slide extends a small distance beyond its detent to facilitate removal of the detent from said undercut by one's finger.

9. In a plastic box as defined in claim 1, a latch wherein said rail projects from a sidewall of the cover part of the box and there is a protrusion on said sidewall which limits movement of the slide to define the open position.

* * * * *